United States Patent [19]

Williams et al.

[11] 4,001,994

[45] Jan. 11, 1977

[54] GLAZING DEVICE

[75] Inventors: Fred Williams, Pittsford; Charles Yackiw, Fairport, both of N.Y.

[73] Assignee: Schlegel Corporation, Rochester, N.Y.

[22] Filed: Nov. 10, 1975

[21] Appl. No.: 630,217

Related U.S. Application Data

[63] Continuation of Ser. No. 502,073, Aug. 30, 1974, abandoned, which is a continuation-in-part of Ser. No. 401,663, Sept. 28, 1973, abandoned.

[52] U.S. Cl. ..... 52/400; 52/397; 52/461; 52/476

[51] Int. Cl.[2] ..... E06B 3/62

[58] Field of Search ..... 52/397–401, 52/476, 502, 461, 732; 428/122, 83

[56] References Cited

UNITED STATES PATENTS

| | | | |
|---|---|---|---|
| 2,342,352 | 2/1944 | Lowry | 52/502 |
| 2,767,814 | 10/1956 | Johnson | 52/401 |
| 3,012,642 | 12/1961 | Emmerich | 52/399 X |
| 3,024,881 | 3/1962 | Haas | 52/501 X |
| 3,198,689 | 8/1965 | Lansing | 52/627 X |
| 3,362,127 | 1/1968 | McGowan | 52/468 |
| 3,455,080 | 7/1969 | Meadows | 52/403 |
| 3,487,602 | 1/1970 | Braun et al. | 52/476 X |
| 3,501,884 | 3/1970 | Di Cesare et al. | 52/397 |
| 3,570,205 | 3/1971 | Payne | 52/403 |

FOREIGN PATENTS OR APPLICATIONS

| | | | |
|---|---|---|---|
| 1,456,933 | 9/1966 | France | 52/397 |
| 1,157,252 | 12/1957 | France | 52/502 |

*Primary Examiner*—Alfred C. Perham
*Attorney, Agent, or Firm*—George W. Shaw

[57] ABSTRACT

A glazing device is formed of a longitudinal strip engaging and holding the periphery of a glass panel, and the strip is formed of a length of spring material with an extruded elastomeric covering. The spring material is formed of a high-tensile-strength, resilient wire element formed in a transverse pattern of zig-zag loops with longitudinally extending rows of knitted strands linking the loops together. The strip is anchored in place against the glass panel so the spring material extends from the anchorage into a cantilevered portion of the strip to engage the glass panel in a displaced position flexing the spring material to produce a predetermined pressure against the glass.

4 Claims, 18 Drawing Figures

GLAZING DEVICE

RELATED APPLICATIONS

This is a continuation of application Ser. No. 502,073 filed Aug. 30, 1974, now abandoned, which is a continuation-in-part of our copending parent application, Ser. No. 401,663, filed Sept. 28, 1973, entitled ARCHITECTURAL GLAZING SYSTEM, and now abandoned.

THE INVENTIVE IMPROVEMENT

Glazing devices have been suggested for holding glass panels in place in buildings and for holding windshields in place in automobiles and trucks, and such devices have to meet many specifications relative to the force of wind and weather, variations in temperature, ease and security of installation, retention of glass in a crash, etc. Glazing devices thus present difficult problems in achieving optimum solutions.

The invention involves recognition of the problems encountered by glazing devices, and proposes a simpler and better solution using a spring material enclosed in an elastomeric casing and arranged to press tightly against the glass to seal the glass and hold it securely in place. The invention aims at security, ease of installation, and reliable functioning in all weather and operating conditions.

SUMMARY OF THE INVENTION

The inventive glazing device includes a longitudinally extending strip for engaging and holding the periphery of a glass panel. The strip includes a length of spring material and an elastomeric material extruded over and encasing the spring material. The spring material is formed of a high-tensile-strength, resilient wire element formed in a transverse pattern of zig-zag loops with the pattern extending along the length of the strip, and longitudinally extending rows of knitted strands link the loops together in the zig-zag pattern. The strip is anchored in place adjacent the glass panel so a cantilevered portion of the strip extends from the anchorage to engage the glass panel. The spring material extends from the anchorage into the cantilevered portion to the region of the engagement of the strip with the glass panel, and the glass is held in a position displacing the cantilevered portion to flex the spring material in the region between the anchorage and the engagement with the glass to produce a predetermined pressure of the strip against the glass panel for sealing and holding the glass securely in place.

DRAWINGS

DETAILED DESCRIPTION

Figure 9:
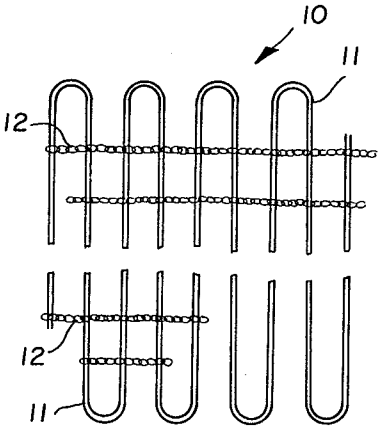
FIG. 9 is a partially schematic, plan view of a preferred embodiment of a carrier material for use in the inventive glazing device.

The inventive architectural glazing device includes a resilient carrier providing springiness and resilient strength for securely supporting and sealing glazing strips in place. Suitable carriers can be formed of several materials such as resilient plastic, resilient plastic wire, and metal in the form of sheets, slotted sheets, perforated sheets, and expanded metal. However, a preferred form of carrier 10 is shown in FIG. 9 as zig-zag wire loops 11 held together by stitching 12 and extending longitudinally through the metal loops. The result is generally non-stretchable longitudinally but sufficiently flexible laterally to be bent into a coil. Wire loops of carrier 10 can be bent into any desired cross-sectional shape by generally known roll-forming methods, and although carrier 10 is familiar in other environments, it has not been used in architectural glazing strips. The desired strength and resilience of carrier 10 can be adjusted by varying the size and tensile strength of the wire in loops 11 and by varying the position and numbers of rows of stitching 12. Either carrier 10 as illustrated in FIG. 9 or another suitable carrier is used in each of the glazing devices shown in FIGS. 1–8 and illustrated therein only schematically.

In addition to forming carrier 10 in different ways of different materials, the elastomeric material covering carriers 10 can be formed of a variety of rubber and synthetic rubber materials. The covering of carriers 10 with elastomeric material is preferably accomplished in a cross-head extruder so that carrier 10 is formed and shaped as desired and then provided with an extruded covering of elastomeric material to complete each strip of the inventive glazing device. The drawings show that many configurations are possible for the inventive device, and those skilled in the art will understand that other configurations can be used for specific circumstances.

Figure 1:
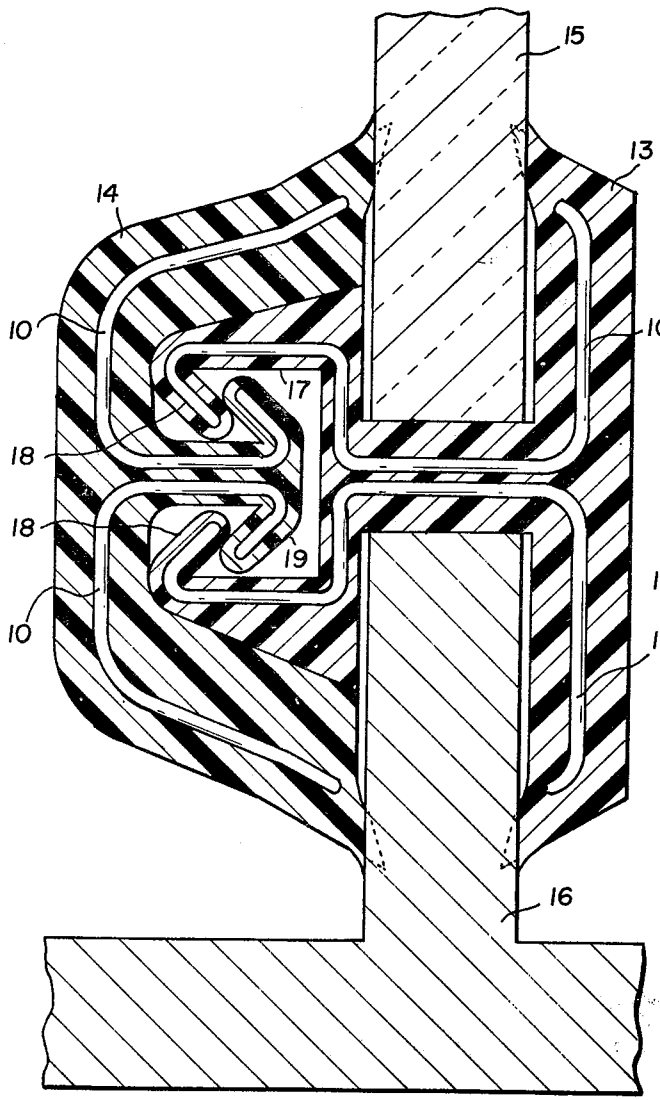

The glazing device of FIG. 1 includes a pair of strips 13 and 14 each having a pair of carrier strips 10 as illustrated, and positioned to hold a glass panel 15 on a structural edge 16. Edge 16 is generally in the plane of glass panel 15 and extends toward glass panel 15 around the periphery of glass panel 15. Strip 13 extends through the space between panel 15 and edge 16, and includes a slot 17 having inturned edges 18. Strip 14 extends around slot 17 and has a double-edge hook 19 engaging the edges 18 of slot 17 to hold strips 13 and 14 together. Carriers 10 extend into hook 19 and straddle slot 17 to secure the engagement of strips 13 and 14 together. Carriers 10 also extend into the regions where strips 13 and 14 engage the surfaces of glass panel 15 and structural edge 16 to press strips 13 and 14 securely and tightly in place. Either strip 13 or 14 can be an interior strip, and when the other strip is pressed into locking engagement, the two strips firmly seal both the inner and outer surfaces of panel 15 and edge 16.

Figure 2:
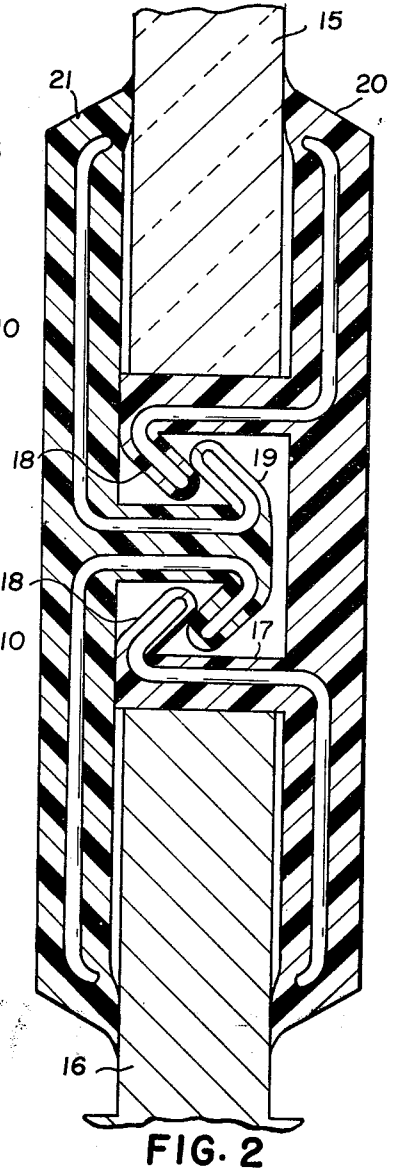

The glazing device of FIG. 2 is similar to the device of FIG. 1, except that strips 20 and 21 are shaped to place slot 17 and hook 19 between edge 16 and panel 15 in the same plane as edge 16 and panel 15. This leaves the device of FIG. 2 generally plane on both sides of the mounting and otherwise functions in the same way as the device of FIG. 1.

Figure 3:
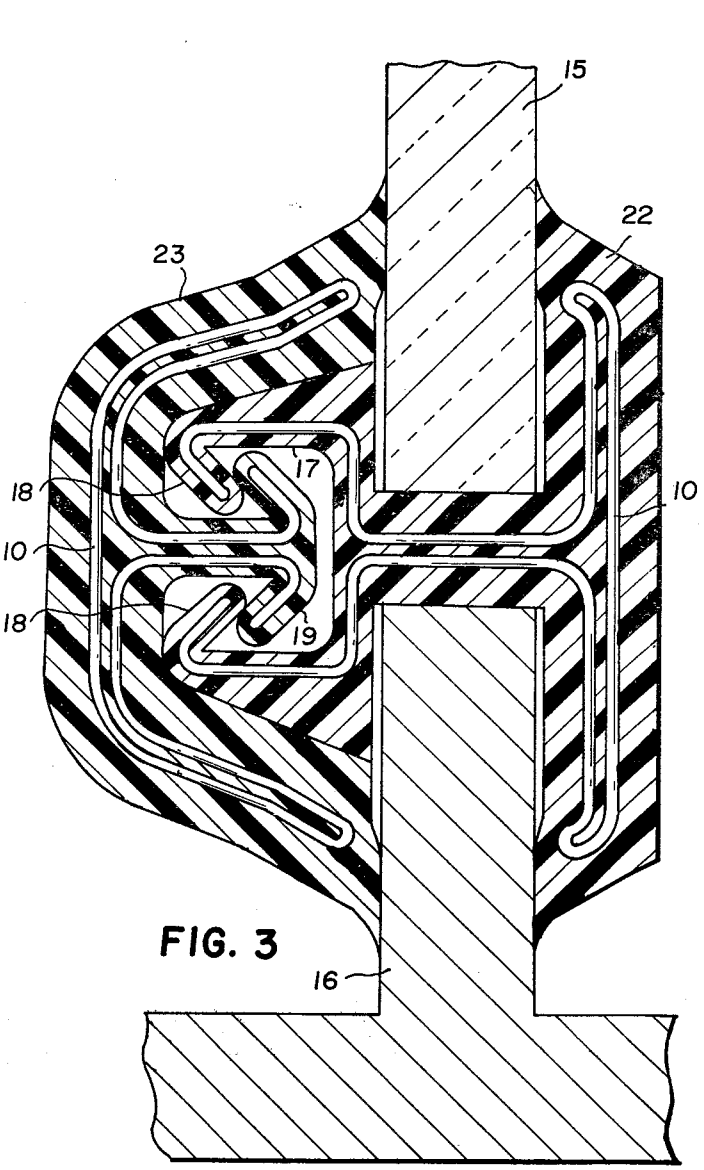
FIGS. 1–8 are partially schematic, cross-sectional views of four preferred embodiments of the inventive glazing device holding a glass panel in place on a structural edge.

The device of FIG. 3 is similar to the device of FIG. 1, except that strips 22 and 23 each have a single, continuous length of carrier strip 10 extending into both the regions of engagement with edge 16 and panel 15 and respectively around slot 17 and into hook 19. This requires a greater width of carrier material 10 but only two pieces of carrier material 10 — one for each strip 22 and 23, and it also makes a somewhat stronger construction than shown in FIG. 1.

Figure 4:
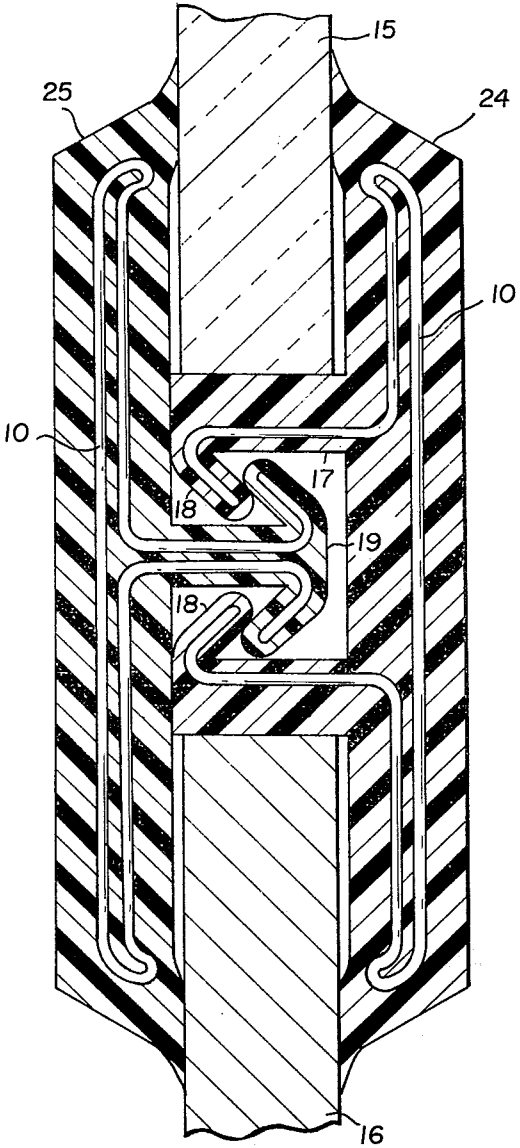

The glazing device of FIG. 4 is similar to the device of FIG. 2, except that strips 24 ad 25 have single-piece carriers 10 as shown in the device of FIG. 3. This also requires a wider carrier 10, but can be made stronger than the device of FIG. 2.

Figure 6:
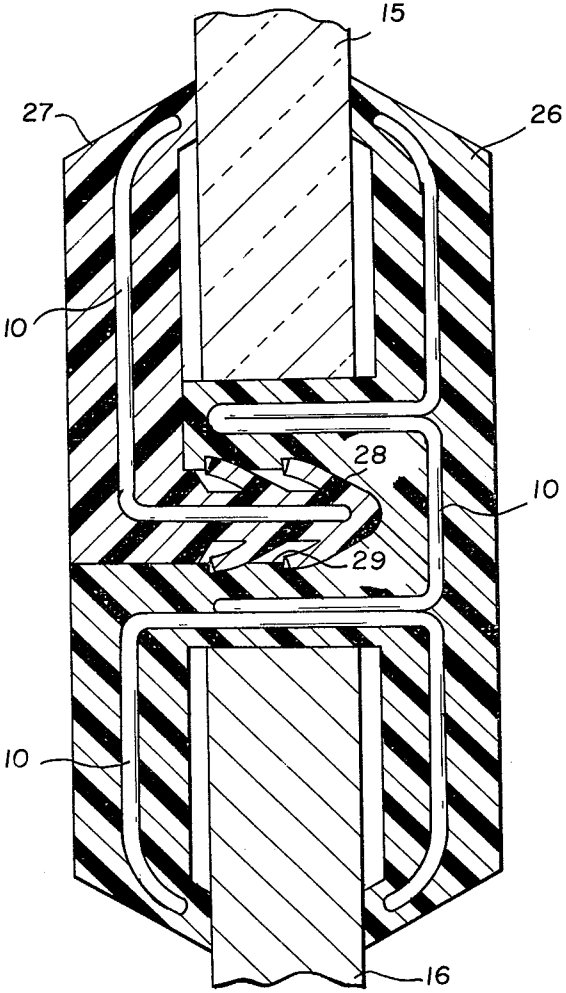
Figure 5:
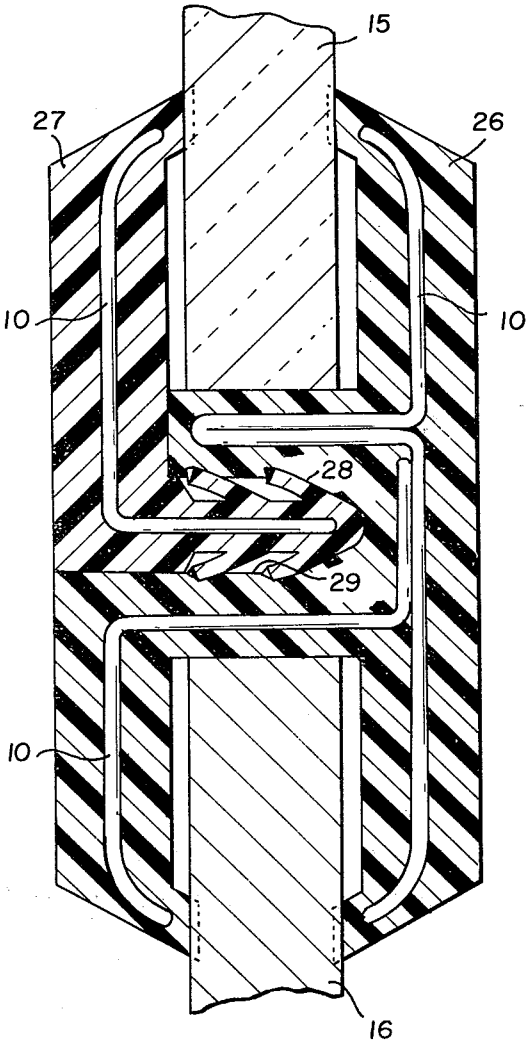

The devices of FIGS. 5 and 6 are similar in having a strip 26 shaped to engage both the inner and outer surfaces of edge 16 or panel 15 and one of the surfaces of the opposite member, and strip 27 engages the other surface of the opposite member and has a hook 28 locking into a slot 29 in strip 26. Strip 26 is secured in place preferably to straddle the inner and outer surfaces of a structural edge, a glass panel is placed against the inwardly extending portion of strip 26, and strip 27 is locked to strip 26 to seal the other surface of the glass panel 15 for securely holding it in place. The differences between the embodiments of FIGS. 5 and 6 are in the shaping and joining of two carriers 10 in strip 26, the FIG. 5 variation having a double thickness of carrier 10 on one side of slot 29 and the FIG. 6 variation having a double thickness of carrier 10 on both sides of slot 29.

Figure 8:
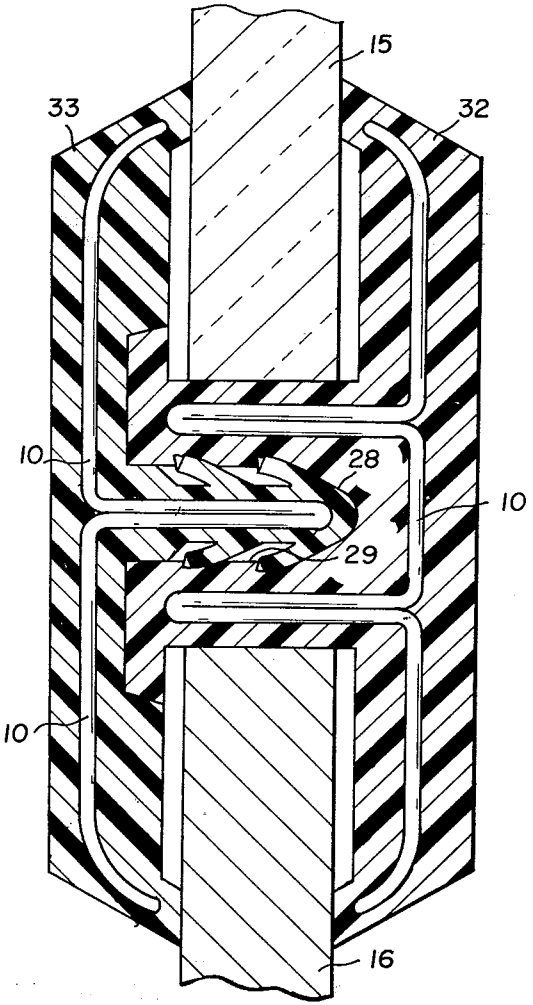
Figure 7:
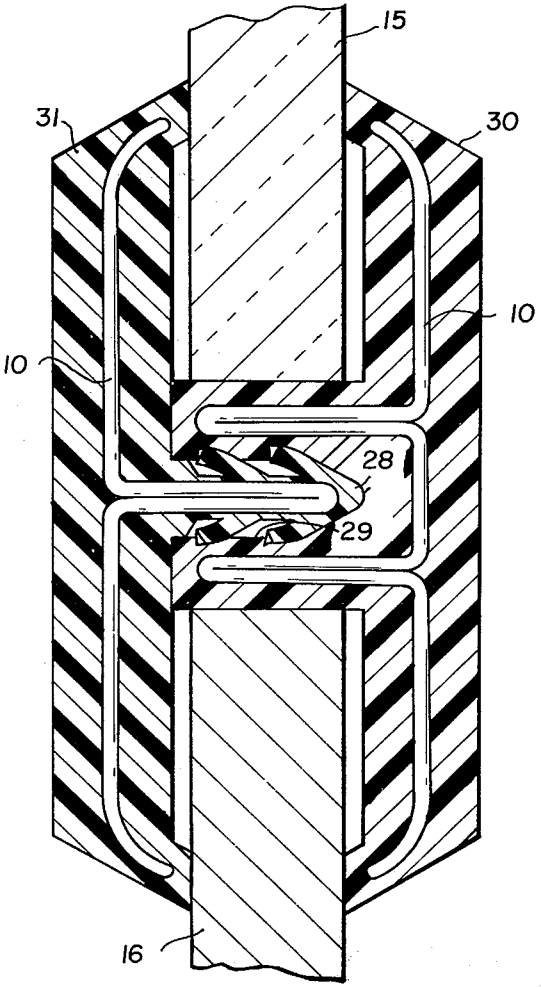

The embodiments of FIGS. 7 and 8 are similar in having strips 30 and 31 (FIG. 7) and 32 and 33 (FIG. 8) having respectively a slot 29 and a hook 28 for interlocking together to hold the strips on opposite sides of edge 16 and panel 15. The embodiments of FIGS. 7 and 8 are also similar to the embodiments of FIGS. 2 and 4, except for a different shaping of carrier strips 10, hook 28 and slot 29. The FIGS. 7 and 8 embodiments differ from each other where strip 32 of FIG. 8 extends a small distance around the edges of panel 15 and edge 16, and strip 30 of FIG. 7 merely extends through the space between panel 15 and edge 16.

The inventive glazing device is strong, rugged and securely engages a structural edge and a glass panel and holds the glass firmly and tightly in place to keep a seal against all weather conditions, and it is easy to install and is secure after installation.

Experience with the invention since the parent application was filed has resulted in some improved ways of applying a glazing device in architectural constructions, and expansion of the glazing device into the automotive field. Also, the design and function of the "carriers" has become increasingly important. The advances in knowledge about practicing the invention are explained below.

Carrier 10 as shown in FIG. 5 is highly preferred for use in the inventive glazing device, and is essentially a spring material providing the resilience to give the glazing device the necessary sealing and holding pressure against the glass panel. Spring material 10 is preferably formed of a high-tensile-strength resilient wire element, preferably of a metallic material such as high-carbon steel, although some high-tensile-strength resin materials are beng developed that may provide characteristics to form a spring. By selecting a wire element of the proper tensile-strength, diameter, and number of loops per unit of length, the resilience and spring bias of spring material 10 can be adjusted to fit any particular design. Spring material 10 then provides the resilience and gripping force to hold the glazing device securely against the glass and hold the glass in place, and prior art glazing devices lacking an internal spring have a less reliable and less forceful grip.

Glazing devices presently made for architectural and automotive purposes are formed of elastomeric material and provide a gripping force by using a substantial mass of elastomer. These encounter several problems, however, because there is a fairly wide manufacturing tolerance on the ultimate durometer of the elastomeric product, and its firmness or stiffness varies widely with temperature. Also, it loses much of its original grip after a few years, and these characteristics lead to many problems and dangers.

Encasing a spring material within an elastomer relieves the elastomer of gripping requirements which are provided by the spring so that the elastomer can become merely a cover and casing material and provide a sealing surface pressed against the glass. The spring formed of a zig-zag wire element can be designed to provide whatever gripping force is desired, and can do so within a narrower range of tolerance than is possible in relying on the elastomer to do the gripping. Also, the resilient grip provided by the spring material inside the glazing device does not reduce substantially with age and does not vary with changes in temperature so that the resulting grip is predictable, constant, and reliable throughout the life of the seal. This insures that the glass panel is held securely in place and greatly reduces the expense of repair or replacement of glazing devices.

Not only must spring material 10 be properly constructed to give the desired resilience and grip, but it must be properly configured relative to its anchorage and to the glass panel held in place so that the spring material extends from an anchorage region into a cantilevered portion of the glazing device to the region where the elastomer engages the glass. Then in the final assembly, spring material 10 is flexed from a relaxed position to provide the desired pressure against the glass panel. Considering the necessary manufacturing tolerances between the glass size and the frame size, a strong grip by the glazing device as provided by spring material 10 is an important feature of the invention in securely gripping and holding glass panels in place. Also, the powerful grip made possible by spring material 10 is useful in automotive windshield mountings for holding the windshield in place in crashes to help keep the occupants safely within the vehicle. Standards for retention of automotive windshields are increasing, and the powerful grip provided by spring material 10 is one efficient and economical way to meet such standards.

Figure 10:
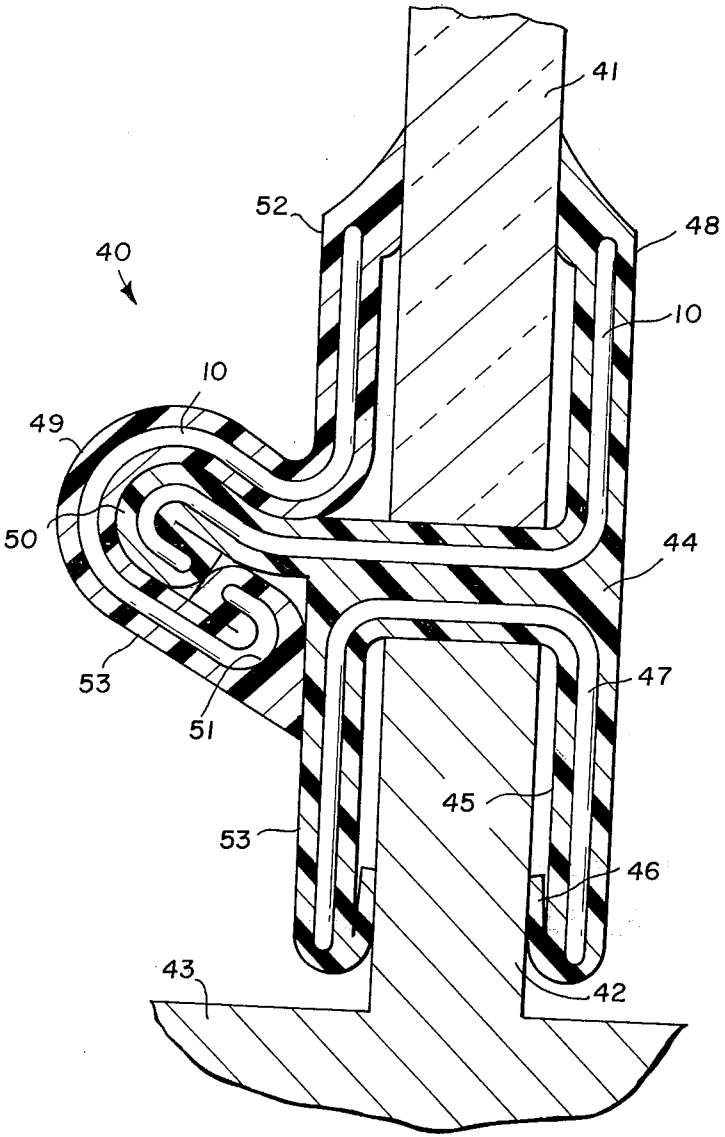

Glazing device 40 of FIG. 10 shows a preferred two-part glazing device for supporting glass panel 41 within a structural edge 42 in an architectural frame 43. Element 44 provides an anchorage, including a channel 45 straddling edge 42 and locked onto edge 42 by holding projections 46. A length of a zig-zag wire element spring material 47 similar to spring material 10 is formed into a U shape as illustrated to give channel 45 a firm grip on edge 42.

Element 44 also includes a spring 10 formed as illustrated to extend into a cantilevered free edge 48 engaging one side of glass panel 41 with spring material 10 providing a firm resilient grip. Element 49 is formed to interlock with an enlarged edge 50 of element 44, and spring material 10 inside of element 49 is bent into a U shape surrounding element 50 and has an enlarged head 51 snapping over and interlocking with head 50 to provide an anchorage for element 49. A cantilevered edge 52 of element 49 extends upward to engage the opposite side of glass panel 41, and cantilevered edges 48 and 52 exert a firm grip against glass panel 41 for holding it securely in place. The spring materials of elements 44 and 49 are encased in an extruded covering of an elastomeric material 53 to enhance the frictional grip of the device and to conform to glass 41 and edge 42 for a secure seal. The interlocking anchorage between elements 44 and 49 braces both elements securely relative to edge 42 so that cantilevered edges 48 and 52 are flexed in the final engagement with glass panel 41 and provide the necessary gripping force. Elastomeric cover 53 is then relieved of gripping responsibility by itself.

Figure 11:
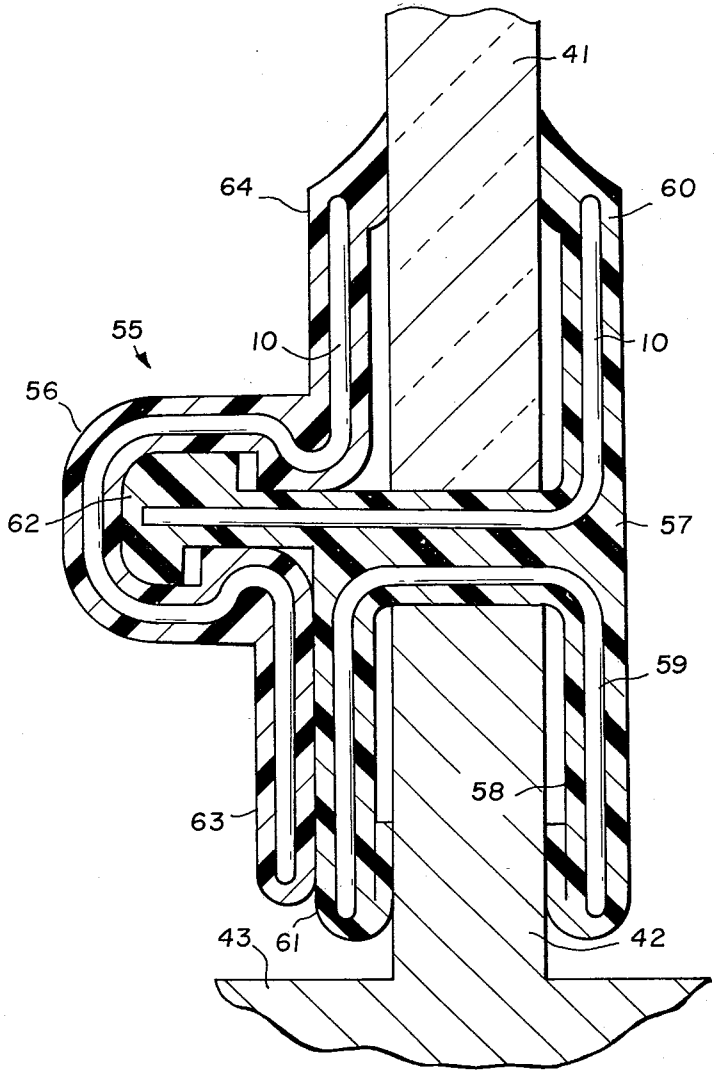
FIGS. 10 and 11 are partially schematic, cross-sectional views of preferred embodiments of the inventive glazing device applied to an architectural glazing.

Glazing device 55 of FIG. 11 is similar to glazing device 40 of FIG. 10, except for having a different form of interlock between elements 56 and 57. Element 57 has a gripping channel 58 biased by zig-zag wire spring element 59 for gripping edge 42 and also includes a zig-zag spring 10 biasing a cantilevered edge 60 into gripping engagement with glass panel 41. The elastomeric covering 61 over element 57 is thickened to form a head region 62, and spring material 10 of element 56 is formed to wrap around head 62 to interlock elements 56 and 57 together. Element 56 includes a bracing leg 63 pressed against the outside of gripping channel 58 of element 57 and a cantilevered arm 64 biased tightly against glass 41 by the resilience of spring material 10. Element 57 is fitted over edge 42, then element 56 is snap-fit over head 62 so that cantilevered arms 60 and 64 press inward for a firm grip on opposite sides of glass panel 41.

Figure 12:
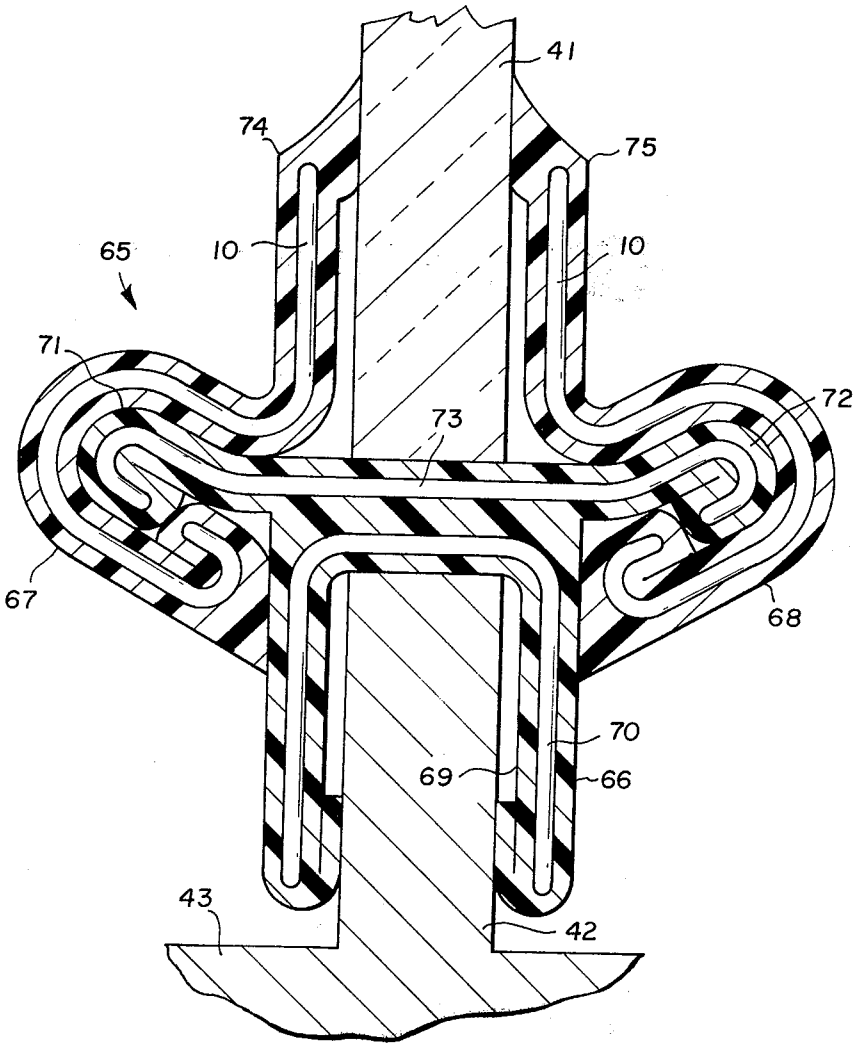
FIG. 12 is a partially schematic, cross-sectional view of a preferred embodiment of a three-part glazing device for architectural purposes.

Glazing element 65 of FIG. 12 is a three-piece device including an anchorage 66, and a pair of glazing elements 67 and 68. Anchorage element 66 has a channel 69 biased by a zig-zag spring wire element 70 for gripping edge 42 and also includes a pair of anchorage heads 71 and 72 that are reinforced by spring material 73 bent back on its ends as illustrated. Elements 67 and 68 each have spring material 10 formed to wrap respectively around heads 71 and 72 for an interlock with anchorage 66, and springs 10 bias cantilevered arms 74 and 75 tightly against opposite sides of glass 41 to hold glass 41 securely in place. Anchorage 66 is fitted over edge 42, and then glass 41 is positioned in the opening inside edge 42 by movement into place either from the interior or the exterior, and one of the strips 67 and 68 is preferably positioned on anchorage 66 before this is done. When glass 41 is positioned against one of the strips 67 or 68, the other strip 67 or 68 is snapped in place over anchorage 66 to press against glass 41 and complete the installation. If glass 41 needs to be replaced, either one of the strips 67 or 68 can be removed and replaced along with glass panel 41.

Figure 13:
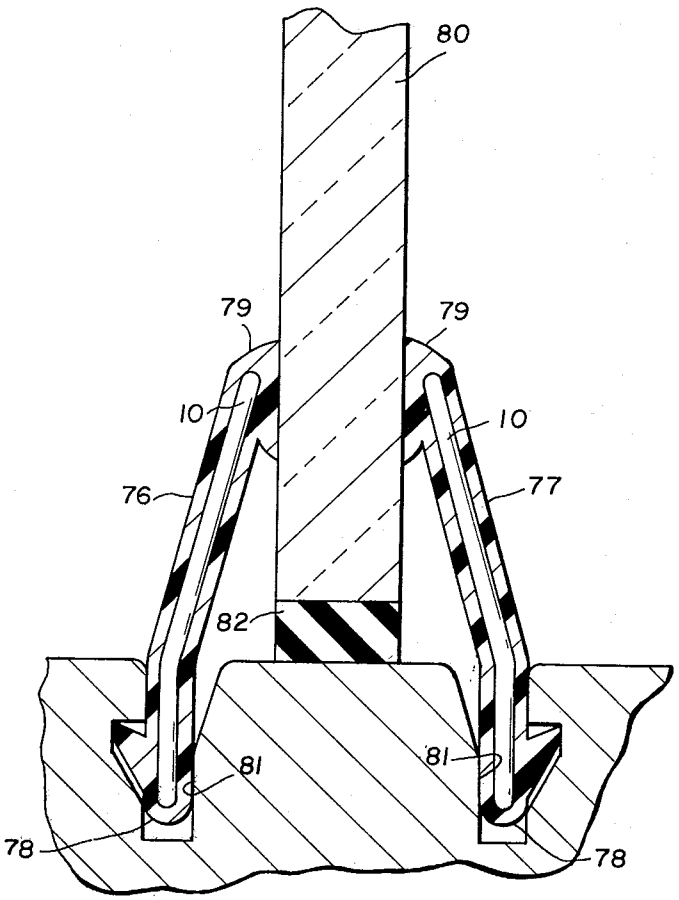
FIGS. 13–15 are partially schematic, cross-sectional views of additional preferred embodiments of the inventive glazing device for architectural purposes.

FIG. 13 shows another form of the inventive glazing device using a pair of glazing strips 76 and 77 each having an internal spring material 10 extending from anchorage region 78 into cantilevered edge region 79 engaging glass panel 80 as illustrated. Anchorages 78 are lodged respectively in slots 81 on opposite sides of glass panel 80 which rests on a spacer block 82 between slots 81. One of the strips 76 or 77 is pressed in place in a slot 81, glass 80 is moved into position, and the other strip 76 or 77 is then pressed in place so that springs 10 in each of the strips 76 and 77 are flexed to press cantilevered arms 78 tightly against glass 80 to seal glass 80 and hold it securely in place.

Figure 14:
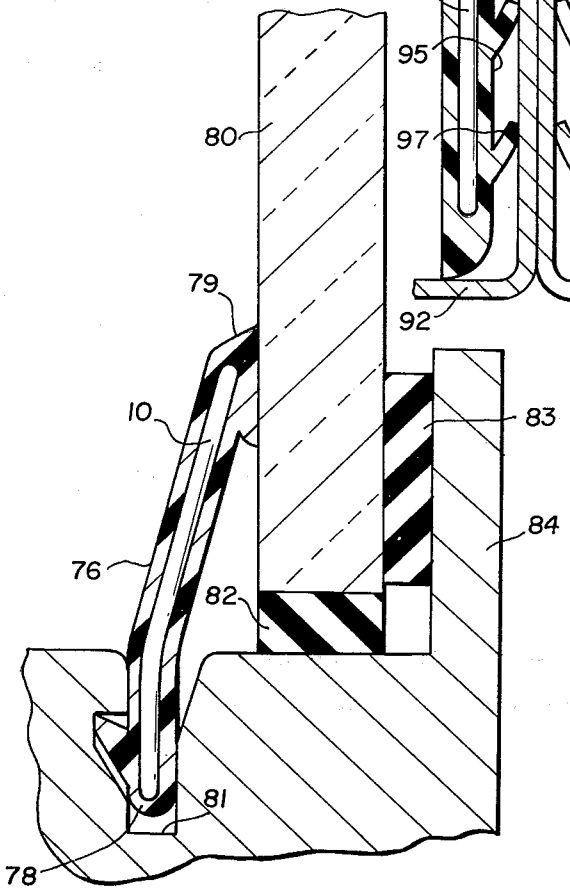

The embodiment of FIG. 14 is similar to the embodiment of FIG. 13, except that glazing strip 77 is replaced by a tape or strip 83 secured to a structural edge 84 around glass 80 and formed of an elastomeric material that is slightly deformable under the pressure of cantilevered edge 79 of strip 76 biased by spring material 10 pressing against glass panel 80. Strip 83 holds glass 80 yieldably against glazing strip 76 whose spring 10 produces the required sealing pressure.

Figure 15:
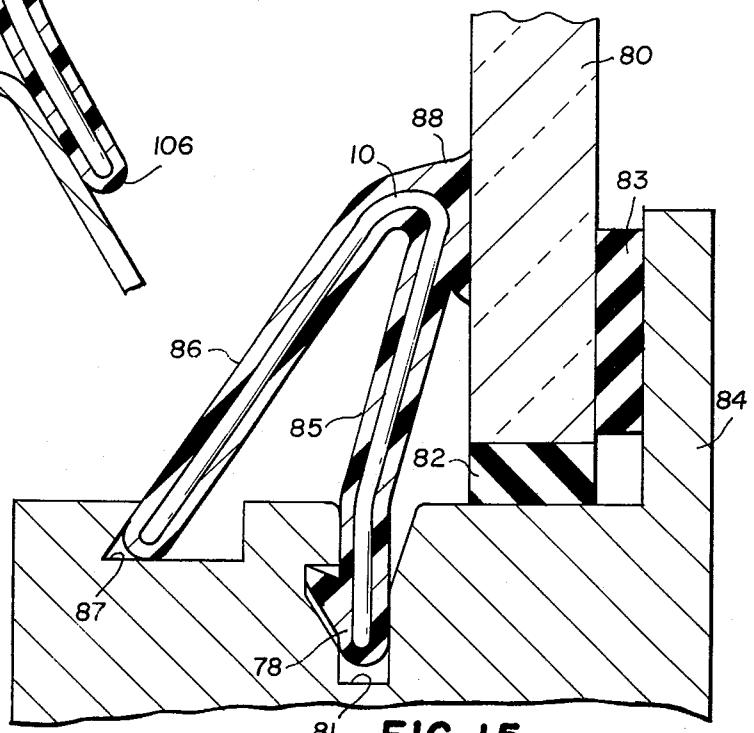

The embodiment of FIG. 15 is similar to the embodiment of FIG. 14, except that glazing strip 85 is extended to have a brace leg 86 lodged in a notch 87 spaced from anchorage slot 81 so that the cantilevered end 88 of glazing strip 85 is also supported by brace leg 86 to increase the pressure applied to glass 80 which is pressed against elastomeric gasket 83 supported on structural edge 84. Spring material 10 extends from the region of anchorage 78 in slot 81 up to cantilevered edge 88 and back down through brace leg 86 to give the desired springy resilience throughout the cross-sectional length of glazing strip 85.

Figure 16:
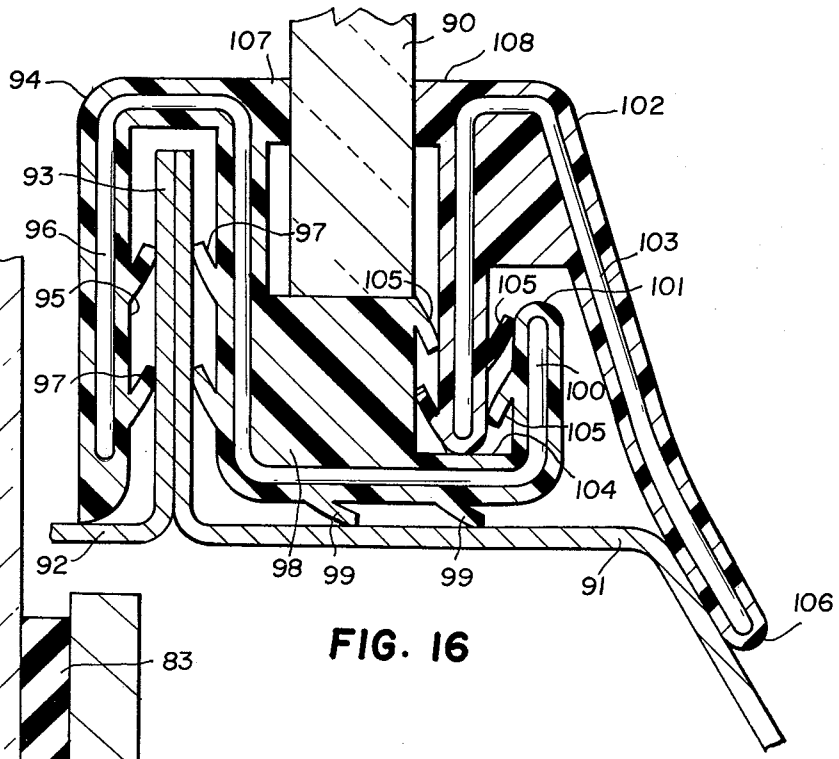
FIGS. 16–18 are partially schematic, cross-sectional views of preferred embodiments of the inventive glazing device for holding and sealing automotive windshields.
Figure 18:
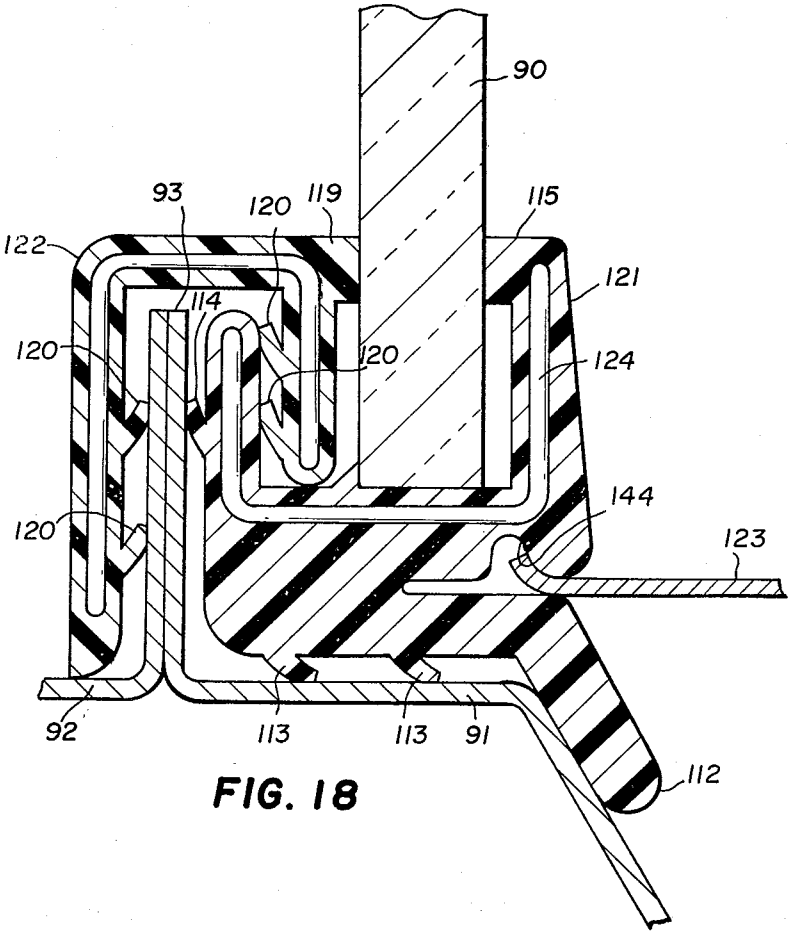
Figure 17:
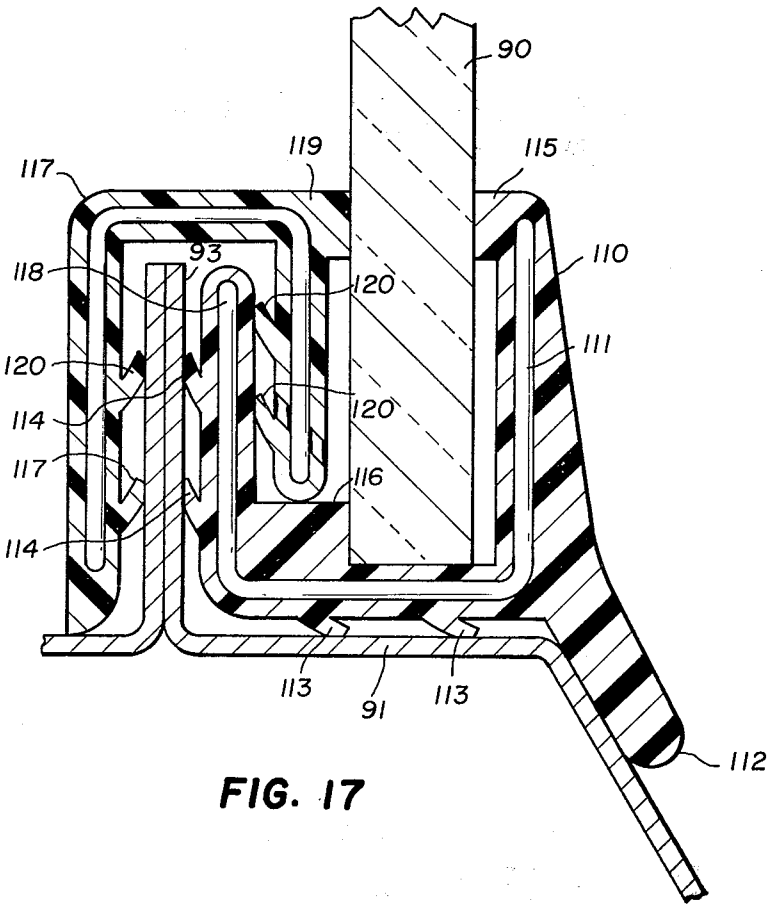

FIGS. 16–18 show three preferred embodiments of the inventive glazing device used to support an automotive windshield 90. Sheet metal strips 91 and 92 are secured together to form a fence 93 around the opening for windshield glass 90, and each of the glazing devices is secured in place around fence 93 and grips windshield glass 90 with sufficient resilient force to provide a good seal and a reliable hold on glass 90 even during a crash.

In the embodiment of FIG. 16, element 94 has a channel 94 reinforced by a zig-zag wire spring element 96 for retaining a position on fence 93 by pressing projections 97 tightly against fence 93. Element 94 also includes a block 98 supporting the edge of glass 90 and projections 99 wedging against sheet metal strip 91 to help hold element 94 securely in place. Spring member 96 of element 94 extends under glass 90 and has an upturned cantilevered end 100 supporting cantilevered edge 101 on the opposite side of glass 90 from fence 93.

A retainer element 102 having a zig-zag spring wire element 103 is shaped to fit in a notch 104 formed inside of cantilevered end 101, and projections 105 interfere to hold strip 102 securely in notch 104. Strip 102 also has a free end 106 that is deformed to the solid-line position from the relaxed broken-line position as illustrated to seal tightly against sheet metal 91. Element 94 has a bearing edge 107, and element 102 has a corresponding bearing edge 108 pressing against opposite sides of glass 90 and biased tightly against glass 90 by the interlock between elements 94 and 102, and by the cantilevered bracing of leg 106 of element 102. The pressure between edges 107 and 108 is determined partly by the tensile strength, diameter, and number of loops per unit of length of spring elements 96 and 103, and is preferably sufficient to retain glass 90 in its mounted position even during a crash of the vehicle. Element 94 is mounted on fence 93, then glass 90 is placed on block 98 of element 94, then retainer strip 102 is pressed in place to interlock with element 94 and press against glass 90 with the desired pressure.

The embodiment of FIG. 17 uses an element 110 having a zig-zag wire spring 111 formed into a channel shape as illustrated to straddle glass 90. Element 110 has a cantilevered edge 112 biased from the broken-line position to the solid-line position in the illustrated engagement with sheet metal 91 to seal against sheet metal 91, and projections 113 interlock with sheet metal 91 and projections 114 interlock with fence 93. Element 110 also has an edge 115 for engaging the outer face of windshield 90, and another edge 116 positioned to receive the peripheral edge of windshield 90. Edges 115 and 116 are formed of the elastomeric material encasing spring material 111. Element 110 is placed around the edge of windshield glass 90, along with element 110, is pressed toward fence 93. Then element 117 is fastened over fence 93 and over upstanding leg 118 of spring material 111 to interlock elements 110 and 117 together. Element 117 also has an edge 119 engaging glass 90 opposite the engagement of edge 115. Projections 120 retain element 117 on fence 93 and provide interlocking engagement with upstanding leg 118 of element 110. Element 117 then draws element 110 tightly into engagement with fence 93, and also presses edge 119 against glass 90 so that edges 115 and 119 squeeze glass 90 tightly from opposite sides and hold it securely in place relative to fence 93, even during a crash of the vehicle.

The embodiment of FIG. 18 is similar to FIG. 17, except that elements 121 and 122 are somewhat differently shaped to accommodate a trim strip 123 secured in a notch 144 in element 121. Cantilevered edge 112 and projections 113 and 114 remain the same, and element 121 includes a zig-zag wire spring element 124 that is also U shaped to straddle the edge of glass 90. Locking element 122 is similar to element 117 of FIG. 17 and has projections 120 for interlocking with element 121 and holding the glazing system securely on fence 93. Edges 119 and 115 squeeze against opposite faces of windshield glass 90 under the bias of spring element 124 for a tight and secure seal and mount.

The illustrated embodiments of the invention show some of the many ways that spring material can be shaped for various sorts of mounts that support the spring material to press resiliently against the glass panel. Also, elastomeric coverings for the spring elements can have many shapes to cooperate with the spring element in engaging and sealing the glass panel and the structure within which the panel is mounted. Those skilled in the art will understand the many materials and configurations possible in applying the invention to various glass panel mountings.

We claim:

1. A glazing device for supporting a glass panel in place relative to an anchorage region around said glass panel, said glazing device including longitudinally extending inner and outer strips interlocked together and supported in place in said anchorage region to have a cantilevered free end portion of each of said strips extending farthest from said anchorage region and respectively engaging inner and outer peripheral surfaces of said glass panel, each of said strips comprising a length of spring material and an elastomeric material extruded over and encasing said spring material, and said glazing device comprising:

a. said spring material being in a fixed position in said anchorage region and extending to said cantilevered free end portion of each of said strips to a relatively movable position in the region of said engagement of each of said strips with said glass panel;

b. said spring material extending closely around the region of said interlock between said strips to provide gripping force for said interlock for firmly holding said strips in interlocked relation so said spring material in said cantilevered free end portion of each of said strips is flexibly displaced from a relatively relaxed position to a position forcing said engagement region of each of said strips against said glass panel with a predetermined pressure sealing and holding said glass panel in place;

c. said spring material being formed of a resilient wire element formed in a transverse pattern of zig-zag loops, said pattern extending along the length of each of said strips;

d. longitudinally extending rows of knitted strands linking said loops together in said zig-zag pattern; and e. said predetermined pressure being a function of the tensile strength of said wire element, the diameter of said wire element, the material of said wire element, and the number of said loops per unit of length of said strip.

2. The glazing device of claim 1 wherein said anchorage region has a fixed support edge near the perimeter of said glass panel, said strips include a gripping channel for fitting over said support edge, and said spring material extends around said channel to provide gripping force for said channel.

3. The glazing device of claim 2 wherein said channel is formed by a portion of each of said strips in said interlocking relation.

4. The glazing device of claim 1 wherein said interlock includes a slot in one of said strips having a gripping force provided by said spring material for receiving and gripping a portion of the other of said strips.

* * * * *